US010381178B2

(12) United States Patent
Kumakiri et al.

(10) Patent No.: US 10,381,178 B2
(45) Date of Patent: Aug. 13, 2019

(54) MOUNT FOR A SWITCHING DEVICE OPERATION KNOB

(71) Applicant: KABUSHIKI KAISHA TOKAI RIKA DENKI SEISAKUSHO, Aichi (JP)

(72) Inventors: Yusuke Kumakiri, Aichi (JP); Wataru Aoki, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 15/791,837

(22) Filed: Oct. 24, 2017

(65) Prior Publication Data

US 2018/0137998 A1 May 17, 2018

(30) Foreign Application Priority Data

Nov. 16, 2016 (JP) ..... 2016-223376

(51) Int. Cl.
*H01H 21/24* (2006.01)
*H01H 23/30* (2006.01)
(Continued)

(52) U.S. Cl.
CPC ..... *H01H 21/24* (2013.01); *H01H 23/14* (2013.01); *H01H 23/145* (2013.01);
(Continued)

(58) Field of Classification Search
CPC .... H01H 23/30; H01H 23/145; H01H 23/205; H01H 2300/01
See application file for complete search history.

(56) References Cited

U.S. PATENT DOCUMENTS 5,803,243 A * 9/1998 Nestor ..... H01H 23/145 200/553
5,878,870 A * 3/1999 Ohtaki ..... H01H 13/023 200/313
(Continued)

FOREIGN PATENT DOCUMENTS

DE 3316564 A1 12/1984
DE 19727213 A1 1/1998
(Continued)

OTHER PUBLICATIONS

Extended European Search Report issued in EP Application No. 17200727.0-1204 dated Mar. 4, 2018.
(Continued)

*Primary Examiner* — Vanessa Girardi
(74) *Attorney, Agent, or Firm* — Roberts Mlotkowski Safran Cole & Calderon, P.C.

(57) ABSTRACT

A switching device includes an operational knob including a first supporting portion including a first coupling portion, the operational knob being enabled to be swung around the first coupling portion as a rotational center, and a switch main body including a second supporting portion including a second coupling portion that rotatably supports the operational knob by being coupled with the first coupling portion. The first supporting portion or the second supporting portion is resiliently deformable when mounting the operational knob on switch main body. The first supporting portion or the second supporting portion further includes an interference lessening portion at a corner of an assembly terminating end side of the first coupling portion or the second coupling portion.

8 Claims, 3 Drawing Sheets

(51) Int. Cl.
*H01H 23/14* (2006.01)
*H01H 23/20* (2006.01)

(52) U.S. Cl.
CPC ..... *H01H 23/30* (2013.01); *H01H 23/205* (2013.01); *H01H 2235/01* (2013.01)

(56) References Cited

U.S. PATENT DOCUMENTS

| | | | | |
|---|---|---|---|---|
| 5,920,042 | A | 7/1999 | Gotoh | |
| 6,013,885 | A * | 1/2000 | Kowalczyk | H01H 23/025 200/302.3 |
| 6,559,393 | B2 * | 5/2003 | Nishikawa | H01H 1/2066 200/558 |
| 8,704,118 | B2 * | 4/2014 | Konno | H01H 23/162 200/339 |
| 8,835,783 | B2 * | 9/2014 | Kiyono | H01H 9/0271 200/293 |
| 2013/0233684 | A1 | 9/2013 | Kato et al. | |

FOREIGN PATENT DOCUMENTS

| | | | |
|---|---|---|---|
| ES | 2244302 | A1 | 12/2005 |
| GB | 2496953 | A | 5/2013 |
| JP | 60-48631 | U | 4/1985 |
| JP | 08-017291 | A | 1/1996 |
| JP | 09-134645 | A | 5/1997 |
| JP | 2013182834 | A | 9/2013 |

OTHER PUBLICATIONS

Office Action issued in the corresponding Japanese Patent Application No. 2016-223376 dated Jan. 30, 2018.

* cited by examiner (CROSS SECTION ALONG LINE A-A)

(CROSS SECTION ALONG LINE B-B)

(ENLARGED VIEW OF PART C)

MOUNT FOR A SWITCHING DEVICE OPERATION KNOB

The present application is based on Japanese patent application No. 2016-223376 filed on Nov. 16, 2016, the entire contents of which are incorporated herein by reference.

BACKGROUND OF THE INVENTION

1. Field of the Invention

This invention relates to a switching device.

2. Description of the Related Art

A switching device is known which is provided with an operational knob operable to swing during a switching operation (see e.g. JP 2013/182834). The switching device is comprised of the operational knob with a display to transmit light, a lever protruded downward on the operational knob, a substrate provided below the operational knob, a fixed contact and a light emitting diode (LED) provided on the substrate, a cylindrical shaft provided in the vicinity of the lever just below the operational knob in a vertical direction to the substrate, a striker that is locked with the lever and can rotate around the cylindrical shaft, a movable contact provided on the striker, and a light guide that guides light emitted from the LED. The device switches ON and OFF by contacting and releasing the movable contact with the fixed contact while the lever rotates striker by swinging the operational knob.

The operational knob and the switch main body are assembled by inserting a supporting axis provided on the switch main body into a coupling hole provided inside the operational knob. Thereby, the switching device is constructed such that the operational knob is supported swingably by the supporting axis of the switch main body.

SUMMARY OF THE INVENTION

In the switching device of JP 2013/182834, the corner of the supporting axis or the coupling hole may be interfered so as to generate a scratch or a burr etc. while assembling the operational knob with the switch main body. Thereby, the operational resistance may increase so as to lower the operational feeling of the operational knob during the swinging operation.

It is an object to provide a switching device that lessens the occurrence of the scratch or the burr etc. so as to maintain the operational feeling even upon occurrence of the scratch or the burr.

[1] According to an embodiment of the invention, a switching device comprises:

an operational knob comprising a first supporting portion comprising a first coupling portion, the operational knob being enabled to be swung around the first coupling portion as a rotational center; and a switch main body comprising a second supporting portion comprising a second coupling portion that rotatably supports the operational knob by being coupled with the first coupling portion, wherein the first supporting portion or the second supporting portion is resiliently deformable when mounting the operational knob on switch main body, and wherein the first supporting portion or the second supporting portion further comprises an interference lessening portion at a corner of an assembly terminating end side of the first coupling portion or the second coupling portion.

[2] The switching device according to [1] may be configured such that the interference lessening portion comprises a chamfered portion at the corner.

[3] The switching device according to [1] or [2] may be configured such that the operational knob is biased by a biasing force from the switch main body such that the first coupling portion abuts on the second coupling portion at the assembly terminating end side.

[4] The switching device according to any one of [1] to [3] may be configured such that the first coupling portion is defined as a hole, wherein the second coupling portion is defined as a cylindrical protruding portion, and wherein the interference lessening portion is formed on the second coupling portion.

[5] The switching device according to any one of [1] to [3] may be configured such that the first coupling portion is defined as a cylindrical protruding portion, wherein the second coupling portion is defined as a hole, and wherein the interference lessening portion is formed on the first coupling portion.

[6] The switching device according to any one of [1] to [3] may be configured such that the first coupling portion is defined as a hole, wherein the second coupling portion is defined as a cylindrical protruding portion, wherein the interference lessening portion is formed on the second coupling portion, and wherein the first supporting portion further comprises an inclined surface that contacts the cylindrical protruding portion of the second coupling portion when mounting the operational knob on switch main body.

[7] The switching device according to [6] may be configured such that the inclined surface contacts the cylindrical protruding portion of the second coupling portion before coupling of the first and second coupling portions when mounting the operational knob on switch main body.

Effects of the Invention

According to an embodiment of the invention of the invention, a switching device can be provided that lessens the occurrence of the scratch or the burr etc. so as to maintain the operational feeling even upon occurrence of the scratch or the burr.

BRIEF DESCRIPTION OF THE DRAWINGS

Next, the present invention will be explained in conjunction with appended drawings, wherein.

DETAILED DESCRIPTION OF THE PREFERRED EMBODIMENTS

Embodiment in the Present Invention

Figure 1:
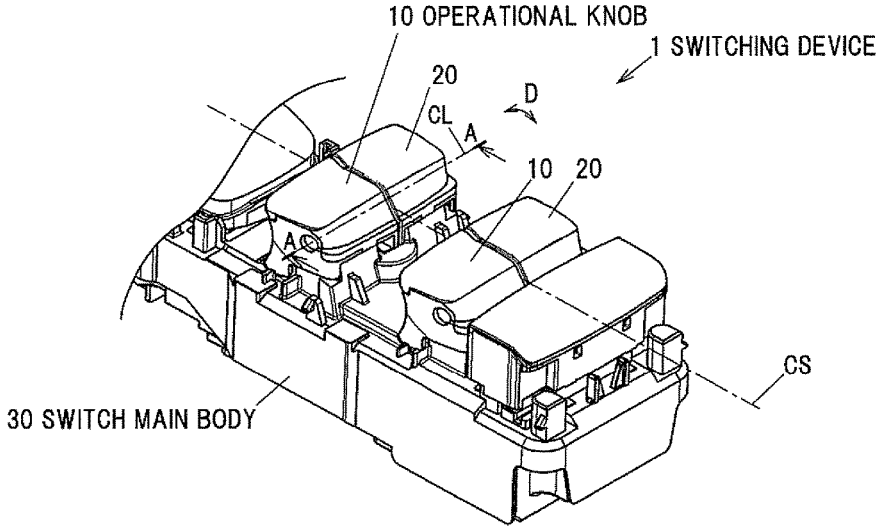
FIG. 1 is a perspective view showing an entire switching device according to the embodiment in the present invention.

A switching device 1 according to the embodiment in the present invention is provided with an operational knob 10 that is provided with a first supporting portion 12 including a first coupling portion and can swing operate around the first coupling portion as a rotational center, and a switch main body 30 that is provided with a second supporting portion 31 including a second coupling portion that rotatably supports the operational knob 10 by coupling with the first coupling portion. The first supporting portion 12 or the second supporting portion 31 can be resiliently deformed in assembled with the switch main body 30. The switching device 1 is configured to having an interference lessening portion at a corner in the assembly terminating end side of the first coupling portion or the second coupling portion.

FIG. 1 is a perspective view showing an entire switching device according to the embodiment in the present invention. As shown in FIG. 1, the operational knobs 10, 20 are assembled with the switch main body 30 in the switching device 1. Although other operational portion is assembled with the switch main body 30, the operational knob will be described below.

As shown in FIG. 1, the operational knob 10 is supported by the switch main body 30 such that the operational knob 10 can swing in the direction D shown in FIG. 1 around a rotational axis CL. The operational knob 20 is arranged so as to have a symmetrical knob shape to the operational knob 10 with respect to a symmetrical axis CS. The switching device 1 is configured to arrange two operational knobs 10 and two operational knobs 20 asymmetry. For example, the switching device 1 is applied to a window switching device for opening and closing a window of a vehicle.

Next, one operational knob 10 shown in FIG. 1 will be described below.

Figure 2A:
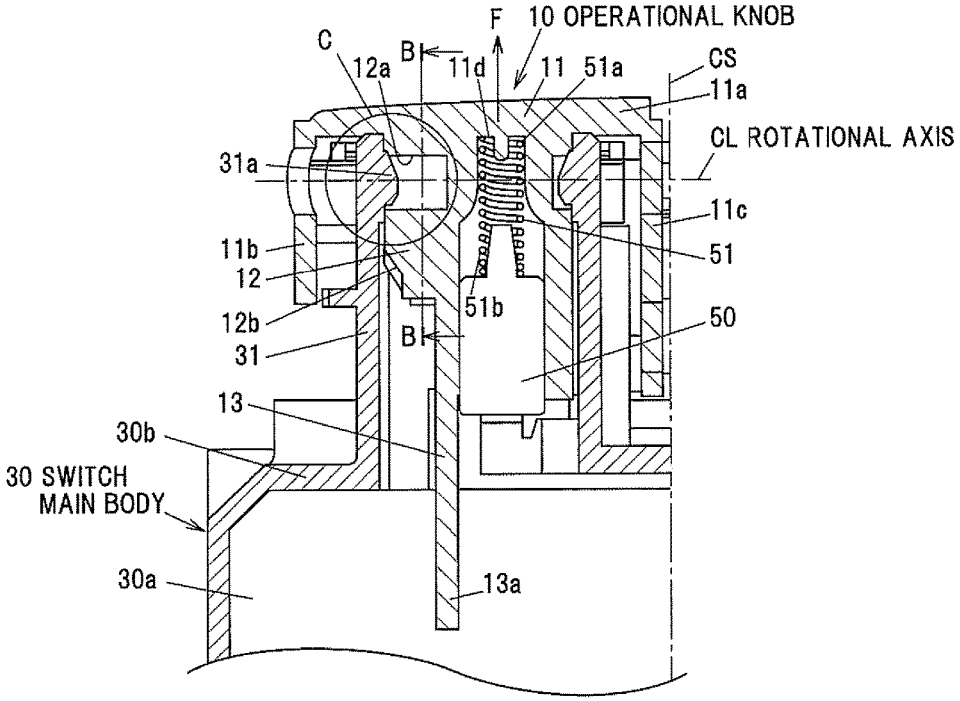
FIG. 2A is a cross sectional view showing the switching device according to the embodiment in the present invention cut along the line A-A.
Figure 2B:
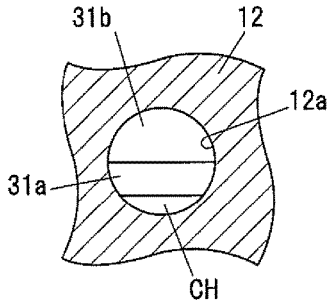
FIG. 2B is a cross sectional view showing the switching device cut along the line B-B shown in FIG. 2A.
Figure 2C:
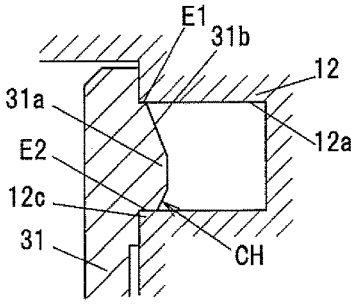
FIG. 2C is an enlarged view of the part C shown in FIG. 2A.

FIG. 2A is a cross sectional view showing the switching device according to the embodiment in the present invention cut along the line A-A. FIG. 2B is a cross sectional view showing the switching device cut along the line B-B shown in FIG. 2A. FIG. 2C is an enlarged view of the part C shown in FIG. 2A.

(Operational Knob 10)

As shown in FIG. 2A, the operational knob 10 is schematically configured from a knob main body 11 operated by a finger, etc., a first supporting portion 12 provided so as to be protruded downward from the knob main body 11, and a switch driving portion 13 formed further downward. Meanwhile, the switch driving portion 13 may be a structure formed downward from the knob main body 11, not the first supporting portion 12.

For example, the operational knob 10 comprises resin such as Acrylonitrile Butadiene Styrene (ABS). In the above structure, the operational knob 10 will be described that the knob main body 11, the first supporting portion 12, and the switch driving portion 13 are integrally formed.

As shown in FIG. 2A, the knob main body 11 is provided with an upper portion 11*a* of the operational knob 10, an outside surface 11*b*, and a central side surface 11*c*. And the knob main body 11 has a bottomed box shape housing the first supporting portion 12 and the switch driving portion 13, etc., on the inside (the upper portion 11*a* of the operational knob 10 corresponds to a bottom).

A locking hole 11*d* that locks an upper end 51*a* of a spring 51 biased from a switch main body 30 side is formed at an approximately center of the knob main body 11.

A coupling hole 12*a* that is defined as the first coupling portion that a rotational center of the rotational axis CL that allows swinging in the direction D shown in FIG. 1 is formed in the first supporting portion 12. The coupling hole 12*a* is rotatably coupled with a cylindrical protruding portion 31*a* that is defined as the second coupling portion formed on the switch main body 30 described below.

As shown in FIG. 2A, in the first supporting portion 12, an inclined surface 12*b* is formed at a lower portion of the coupling hole 12*a* so as to increase activity in an assembly start.

In the present embodiment, the switch driving portion 13 is formed downward at a lower portion of the first supporting portion 12. The switch driving portion 13 is formed such that a tip end portion 13*a* of the switch driving portion 13 extends to an inside portion 30*a* of the switch main body 30. The switch is turned ON and OFF by driving a switch contact inside the switch main body 30 by swing operating (switch operating) the operational knob 10.

(Switch Main Body 30)

As shown in FIG. 2A, the switch main body 30 is schematically configured to be a cylindrical shape or a box shape that is provided with the inside portion 30*a* that is defined as an inner space to house a substrate, the switch contact, a connector, etc., and form the second supporting portion 31 so as to rotatably support the operational knob 10 at an upper portion of the switch main body 30.

For example, the switch main body 30 comprises the resin such as ABS. In the above structure, the second supporting portion 31 will be described such that the second supporting portion 31 is integrally formed with the switch main body 30.

As shown in FIG. 2A, the second supporting portion 31 is formed so as to protrude upward from an upper portion 30*b* of the switch main body 30. The cylindrical protruding portion 31*a* that is defined as the second coupling portion is formed at a tip end portion of the second supporting portion 31. The cylindrical protruding portion 31*a* is protruded toward the coupling hole 12*a* of the first supporting portion 12 and rotatably coupled with the coupling hole 12*a* when the assembly ends.

The second supporting portion 31 can be resiliently deformed when the operational knob 10 is assembled with the switch main body 30 since the second supporting portion 31 comprises the resin such as ABS. Meanwhile, the first supporting portion 12 in the operational knob 10 side can be resiliently deformed relatively when the operational knob 10 is assembled with the switch main body 30 since the first supporting portion 12 also comprises the resin such as ABS. In the present embodiment, the second supporting portion 31 is designed so as to be mainly resiliently deformed when the operational knob 10 is assembled with the switch main body 30.

An outer surface of the cylindrical protruding portion 31*a* that is coupled with the coupling hole 12*a* may be a cylindrical shape. Thus, the cylindrical protruding portion 31*a* may be a columnar protrusion.

As shown in FIG. 2B, a cross section of the cylindrical protruding portion 31*a* is a circular shape. A coupling between the cylindrical protruding portion 31*a* and the coupling hole 12*a* is defined as a loose-fit that allows rotating when the assembly ends.

In FIG. 2C, an upper end of the cylindrical protruding portion 31*a* and an upper end of the coupling hole 12*a* are defined as an assembly starting end E1 when the cylindrical protruding portion 31*a* is coupled with the coupling hole 12*a*. A lower end of the cylindrical protruding portion 31*a* and a lower end of the coupling hole 12*a* are defined as an assembly terminating end E2. As described below, when the operational knob 10 is assembled with the switch main body 30, firstly, the corner 12*c* of the coupling hole 12*a* contacts an assembly starting end E1 side of the cylindrical protruding portion 31*a*, and then, the assembly ends after the corner 12*c* of the coupling hole 12*a* abuts on an assembly terminating end E2 side of the cylindrical protruding portion 31*a*.

As shown in FIGS. 2B and 2C, an inclined surface 31*b* is formed in the assembly starting end E1 side that is an upper side of the cylindrical protruding portion 31*a*. Also, a chamfer CH is formed, as an interference lessening portion, at a corner of the cylindrical protruding portion 31*a* on the assembly terminating end E2 side that is defined as a lower side of the cylindrical protruding portion 31*a*. Meanwhile, the interference lessening portion may be an R surface etc. other than the chamfer. Also, the chamfer CH may be a chamfer of arbitrary angle other than a chamfer of 90°.

As shown in FIG. 2A, a spring supporting member 50 is attached on the upper portion 30*b* of the switch main body 30. A lower end 51*b* of the spring 51 is locked with the spring supporting member 50. The spring 51 biases a biasing force F shown in FIG. 2A to the operational knob 10 by a resilient force when the operational knob 10 is assembled with the switch main body 30. The operational knob 10 is restored automatically to a neutral position after swing operating by the finger, etc., by the biasing force F.

The cylindrical protruding portion 31*a* abuts on the coupling hole 12*a* in the assembly terminating end E2 side by the above biasing force F. Thus, the biasing force F is an operational load in swing operating the operational knob 10. Meanwhile, the biasing force F is desirably set as the small biasing force while an automatic restoring force is maintained so as to decrease the operational load in swing operating by the finger, etc.

(Assembling Operation)

Figure 3A:
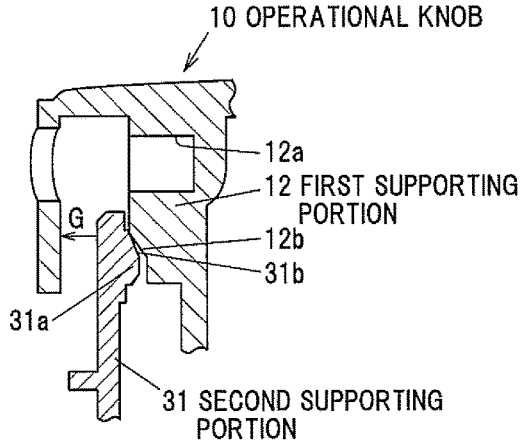
FIG. 3A is a partial cross sectional view of the part C in FIG. 2A in a starting state to abut a cylindrical protruding portion of a switch main body on a hole portion of an operational knob at an assembly starting end side, which shows a process to assemble the operational knob with the switch main body in order.
Figure 3B:
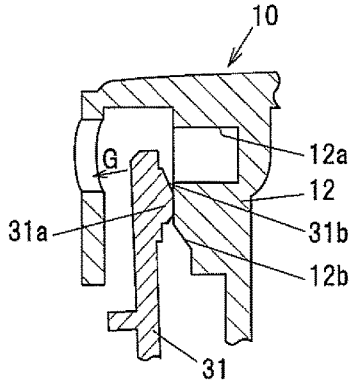
FIG. 3B is a partial cross sectional view showing a halfway state in assembling the hole portion of the operational knob and the cylindrical protruding portion of the switch main body, which shows a process to assemble the operational knob with the switch main body in order.
Figure 3C:
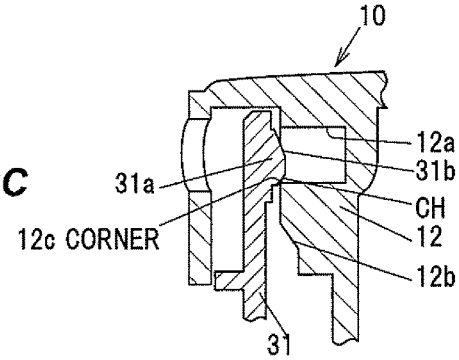
FIG. 3C is a partial cross sectional view showing an abutting state of the hole portion of the operational knob on the cylindrical protruding portion of the switch main body at an assembly terminating end side, which shows a process to assemble the operational knob with the switch main body in order.

FIG. 3A is a partial cross sectional view of the part C in FIG. 2A in a starting state to abut a cylindrical protruding portion of a switch main body on a hole portion of an operational knob at an assembly starting end side, which shows a process to assemble the operational knob with the switch main body in order. FIG. 3B is a partial cross sectional view showing a halfway state in assembling the hole portion of the operational knob and the cylindrical protruding portion of the switch main body, which shows the process to assemble the operational knob with the switch main body in order. FIG. 3C is a partial cross sectional view showing an abutting state of the hole portion of the operational knob on the cylindrical protruding portion of the switch main body at an assembly terminating end side, which shows the process to assemble the operational knob with the switch main body in order.

As shown in FIG. 3A, when the operational knob 10 starts to be assembled from above toward a lower side of the switch main body 30, firstly, the inclined surface 12*b* of the first supporting portion 12 abuts on the inclined surface 31*b* of the cylindrical protruding portion 31*a* of the second supporting portion 31. Thus, the second supporting portion 31 is resiliently deformed and starts to be bent to the direction G.

Next, when the operational knob 10 is assembled with the switch main body 30, as shown in FIG. 3B, the second supporting portion 31 is resiliently deformed and bent largely to the direction G.

As shown in FIG. 3C, on the verge of the assembly terminating, the corner 12*c* of the coupling hole 12*a* abuts on the chamfer CH. In this abutting state, since the chamfer CH performs as the interference lessening portion, the occurrence of the scratch or the burr caused by the corner 12*c* of the coupling hole 12*a* can be lessened.

As shown in FIGS. 2A and 2C, the cylindrical protruding portion 31*a* and the coupling hole 12*a* are rotatably coupled after the state on the verge of the assembly terminating shown in FIG. 3C. Thus, an assembly process that assembles the operational knob 10 with the switch main body 30 ends.

(Switch Operation for the Operational Knob 10)

As described above, the tip end portion 13*a* of the switch driving portion 13 of the operational knob 10 is locked with a contact terminal driving member (not shown) provided on the inside portion 30*a* of the switch main body 30 in the state shown in FIG. 2A that the operational knob 10 is assembled with the switch main body 30. Therefore, a switch contact drives by coordinating the contact terminal driving member with the operational knob 10 when the operational knob 10 is swing operated to the direction D shown in FIG. 1 by the finger, etc. The switch can be operated such as turning ON and OFF.

The operational knob 10 is restored automatically to the neutral position by the biasing force F when the swing operation for the operational knob 10 ends.

On the verge of assembly terminating shown in FIG. 3C described above, since the occurrence of the scratch and the burr caused by contacting the corner 12*c* of the coupling hole 12*a* with the chamfer CH is prevented, rotatably coupling the cylindrical protruding portion 31*a* with the coupling hole 12*a* is maintained. An operability of the operational knob 10 in swing operating is maintained.

Even if the scratch and the burr generated by contacting the corner 12*c* of the coupling hole 12*a* with the chamfer CH are generated, the chamfer CH of the cylindrical protruding portion 31*a* can lessen the effect caused by the scratch and the burr. Thus, rotatably coupling the cylindrical protruding portion 31*a* with the coupling hole 12*a* is maintained. The operability of the operational knob 10 in swing operating is maintained.

Specifically, as described above, the biasing force F in the spring 51 is desirably to be defined as the small biasing force so as to decrease the operational load in swing operating by the finger etc. However, the automatic restoring force to the neutral positon is small in such state. Therefore, effect that prevents the occurrence of the scratch and the burr by the chamfer CH as the interference lessening portion and lessens the effect when the scratch and the burr are generated is significant.

Effects of the Embodiment

The switching device of the embodiment can have effects described below.

(1) The switching device according to the present embodiment is configured to comprise an operational knob comprising a first supporting portion having a first coupling portion that can be swing operated around the first coupling portion as a rotational center; and a switch main body comprising a second supporting portion comprising a second coupling portion that is coupled with the first coupling portion and rotatably supports the operational knob, wherein the first supporting portion or the second supporting portion can be resiliently deformed in assembled with the switch main body, and wherein the first supporting portion or the second supporting portion comprises an interference lessening portion at a corner of an assembly terminating end side of the first coupling portion or the second coupling portion. The second supporting portion 31 is assembled with bending by resiliently deforming in the assembly process to assemble the operational knob 10 with the switch main body 30. Although the corner 12*c* of the coupling hole 12*a* abuts on the chamfer CH on the verge of assembly terminating, the occurrence of the scratch or the burr caused by the corner 12*c* of the coupling hole 12*a* is reduced since the chamfer CH performs as the interference lessening portion.

(2) Even if the scratch and the burr caused by contacting the corner 12*c* of the coupling hole 12*a* with the chamfer CH are generated, the effect caused by the scratch and the burr can be reduced by the chamfer CH of the cylindrical protruding portion 31*a*. That is, even if the scratch and the burr are generated, increasing a load resistance in switch operating can be prevented. Thus, rotatably coupling the cylindrical protruding portion 31*a* and the coupling hole 12*a* is maintained. The operability of the operational knob 10 in swing operating is maintained.

(3) Furthermore, when the corner 12*c* generates the scratch and the burr in assembling, a coupling state (the loose-fit) changes and the operability decreases. Meanwhile, in the present embodiment, since the chamfer CH is provided as the interference lessening portion, the occurrence of the scratch or the burr can be reduced. Thus, a switching device can maintain the operability even if the switching device is configured so as to decrease the operational load in operating the operational knob 10, i.e., lower the set biasing force F in the spring 51.

Although the embodiments of the invention has been described, the embodiments are just examples and the invention according to claims is not to be limited to the above-mentioned embodiment. Further, please note that all combinations of the features described in the embodiment are not necessary to solve the problem of the invention. Replacements, omits, modifications, etc., can be suitably implemented without departing from the gist of the invention.

For example, the first coupling portion is defined as a hole defined in the first supporting portion provided in the operational knob 10 and the second coupling portion that is coupled with the first coupling portion and rotatably supports the operational knob is defined as the cylindrical protruding portion. Meanwhile, the first coupling portion may be a cylindrical protruding portion defined in the first supporting portion provided in the operational knob 10 and the second coupling portion may be a hole.

Also, all combinations of the features described in the embodiments are not necessary to solve the problems of the invention. Further, the accompanying claims and their equivalents are intended to cover such forms or modifications as would fall within the scope and spirit of the inventions.

What is claimed is:

1. A switching device, comprising:

an operational knob comprising a first supporting portion comprising a first coupling portion, the operational knob being enabled to be swung around the first coupling portion as a rotational center; and a switch main body comprising a second supporting portion comprising a second coupling portion that rotatably supports the operational knob by being coupled with the first coupling portion, a biasing member to provide a first biasing force to allow the operational knob to restore to a neutral position when a swinging operation of the operational knob ends, wherein the first supporting portion or the second supporting portion is resiliently deformable when mounting the operational knob on switch main body, and wherein the first supporting portion or the second supporting portion further comprises an interference lessening portion at a corner of an assembly terminating end side of the first coupling portion or the second coupling portion, wherein the second coupling portion protrudes from a cylindrical shoulder forming a profile defined by an inclined surface at an assembly starting end side and an interference lessening portion at an assembly terminating end side.

2. The switching device according to claim 1, wherein the interference lessening portion comprises a chamfered portion at the corner.

3. The switching device according to claim 1, wherein the operational knob is biased by a biasing force from the switch main body such that the first coupling portion abuts on the second coupling portion at the assembly terminating end side.

4. The switching device according to claim 1, wherein the first coupling portion is defined as a hole, wherein the second coupling portion is defined as a cylindrical protruding portion, and wherein the interference lessening portion is formed on the second coupling portion.

5. The switching device according to claim 1, wherein the first coupling portion is defined as a cylindrical protruding portion, wherein the second coupling portion is defined as a hole, and wherein the interference lessening portion is formed on the first coupling portion.

6. The switching device according to claim 1, the first and second supporting portions snap-fit into mechanical interference along a surface of the assembly terminating end side when assembled due to the resilient deformability of the first supporting portion or the second supporting portion, and wherein the interference lessening portion leads into the surface of the assembly terminating end side and reduces stress at the corner of the assembly terminating end side when the first and second supporting portions snap-fit into mechanical interference.

7. The switching device according to claim 1, wherein the first coupling portion is defined as a hole, wherein the second coupling portion is defined as a cylindrical protruding portion, wherein the interference lessening portion is formed on the second coupling portion, and wherein the first supporting portion further comprises an inclined surface that contacts the cylindrical protruding portion of the second coupling portion when mounting the operational knob on switch main body.

8. The switching device according to claim 7, wherein the inclined surface contacts the cylindrical protruding portion of the second coupling portion before coupling of the first and second coupling portions when mounting the operational knob on switch main body.

* * * * *